US007836563B2

(12) United States Patent
Horikawa et al.

(10) Patent No.: US 7,836,563 B2
(45) Date of Patent: Nov. 23, 2010

(54) FASTENER STRINGER AND SLIDE FASTENER

(75) Inventors: Mitsuo Horikawa, Toyama-ken (JP); Hiroyuki Konokawa, Toyama-ken (JP); Eiji Nakayama, Toyama-ken (JP)

(73) Assignee: YKK Corporation, Tokyo (JP)

( * ) Notice: Subject to any disclaimer, the term of this patent is extended or adjusted under 35 U.S.C. 154(b) by 502 days.

(21) Appl. No.: 11/888,608

(22) Filed: Aug. 1, 2007

(65) Prior Publication Data

US 2008/0209694 A1 Sep. 4, 2008

(30) Foreign Application Priority Data

Aug. 11, 2006 (JP) ..... 2006-220114

(51) Int. Cl.
*A44B 19/40* (2006.01)

(52) U.S. Cl. ..... 24/393; 24/391; 24/397; 139/384 B

(58) Field of Classification Search ..... 24/391, 24/392, 393, 394, 395, 396, 397; 139/384 B
See application file for complete search history.

(56) References Cited

U.S. PATENT DOCUMENTS 4,378,683 A * 4/1983 Matsuda et al. ..... 66/193
4,924,560 A 5/1990 Matsuda et al.
5,983,465 A 11/1999 Wakai et al.
6,082,148 A * 7/2000 Wakai et al. ..... 66/192
6,505,652 B1 * 1/2003 Matsushima ..... 139/384 B
2004/0173276 A1 * 9/2004 Horikawa ..... 139/384 B

FOREIGN PATENT DOCUMENTS

| | | |
|---|---|---|
| EP | 0 292 947 | 11/1988 |
| EP | 0292947 | 11/1988 |
| GB | 2054678 | 2/1981 |
| JP | 63-294804 | 12/1988 |

* cited by examiner

*Primary Examiner*—Robert J Sandy
*Assistant Examiner*—Michael Lee
(74) *Attorney, Agent, or Firm*—Alston & Bird LLP

(57) ABSTRACT

A fastener stringer capable of following up stretching/contracting action of a stretchable fabric smoothly by improving a stretching property of an element attaching portion, and capable of preventing breaking of chain if the element attaching portion is stretched, wherein the fastener stringer includes: a woven fastener tape having a tape main portion and an element attaching portion; a continuous fastener element row sewed to the element attaching portion with a non-elastic sewing thread; and an elastic core thread inserted through an interior of the fastener element row, an elastic yarn and a non-elastic yarn are woven into the tape main portion and the element attaching portion as warp yarns while a non-elastic yarn is woven as a weft yarn, and a weaving ratio of the elastic yarn to the non-elastic yarn is larger in the element attaching portion than in the tape main portion.

8 Claims, 2 Drawing Sheets

FASTENER STRINGER AND SLIDE FASTENER

BACKGROUND OF THE INVENTION

1. Field of the Invention

The present invention relates to a fastener stringer for a slide fastener for use in stretchable clothes such as sporting clothes, and more particularly, to a fastener stringer for a slide fastener whose element attaching portion is stretchable and which is capable of preventing breaking of its chain even when the element attaching portion is stretched.

2. Description of the Related Art

Conventionally, a slide fastener has been used in fashion clothes and underwear, and a number of slide fasteners have been used in stretchable clothes such as knit fabric clothes and sporting clothes. There is a need to attach a slide fastener for use in various kinds of stretchable clothes to such clothes with an excellent appearance and further cause the slide fastener to correspond to stretching or contraction of the clothes. For this reason, when the slide fastener tape is woven or knitted, its weaving structure or knitting structure or a material of a composition yarn or the like is selected so as to provide the fastener tape with stretching property. Further, it has been well known that the appearance of the slide fastener is better when it is formed with a woven fastener tape than when with a knitted fastener tape.

In the slide fastener for use in the stretchable clothes described above, its fastener tape is provided with stretching property in a tape longitudinal direction, for example. In this case, generally, the element attaching portion which is formed on one side edge of the fastener tape and on which fastener elements are to be attached is constructed so as not to be stretchable although the tape main body of the fastener tape is provided with appropriate stretching property in the tape longitudinal direction.

The reason will be described below. For example, if the element attaching portion of the fastener tape is stretched when the tape main portion and the element attaching portion of the fastener tape are provided with stretching property, a fastener element row attached to the element attaching portion is also stretched. Thus, when the fastener tape is stretched in a state in which right and left fastener element rows engage each other, the fastener element rows are stretched over a certain extent in the tape longitudinal direction, which causes a fault called breaking of chain wherein an engagement between the elements attached to the element attaching portions is lost. Therefore, in general slide fasteners, the element attaching portion of the fastener tape is often constructed so as not to be stretchable.

Assume that a slide fastener in which a tape main portion of a fastener tape is constructed to be stretchable while an element attaching portion is constructed to be completely non-stretchable is attached to, for example, clothes having stretching property. In this case, when a user takes exercise such as stretching his or her body wearing that stretchable clothes, the element attaching portion is never stretched although the tape main portion is stretched or contracted corresponding to the stretching or contraction of the clothes. For the reason, there may occur such a fault that a pulling phenomenon occurs in a slide fastener attaching portion of the clothes or feeling of disharmony is induced on the appearance of the slide fastener when the user wears such clothes.

To solve such a fault, for example, Japanese Patent Application Laid-Open (JP-A) Publication No. 63-294804 has disclosed a slide fastener in which not only a tape main portion but also an element attaching portion surrounding portion is provided with stretching property. The slide fastener disclosed in JP-A-63-294804 has an elastic yarn (Spandex covered yarn) arranged regularly at specified intervals and a non-stretchable yarns disposed at other portions as warp yarns constituting the tape main portion and element attaching portion of the fastener tape. Further, a coil-like fastener element row in which a core thread is inserted internally is sewed to the element attaching portion of the fastener tape with a sewing thread. As the core thread, there is used a thread having a structure in which an elastic yarn is covered with a covering layer composed of a polyester bulky processed yarn (non-elastic yarn).

The slide fastener with such configuration disclosed in JP-A-63-294804 has a degree of stretching that the element attaching portion is stretched by 10% or more, for example, when a load of 4 kg is applied in the longitudinal direction of the fastener tape because the elastic yarns are disposed regularly at specified intervals on the element attaching portion like on the tape main portion.

On the other hand, a ratio of a quantity of the elastic yarns disposed in the element attaching portion is equal to that of the tape main portion. Further, a number of the non-elastic yarns are woven into the element attaching portion, the core thread is covered with the covering layer composed of the non-elastic yarns, so that a degree of stretching of the core thread itself is suppressed; and the fastener element row and the core thread are sewed to the element attaching portion with the non-elastic sewing thread. For this reason, a pitch between adjacent elements when the fastener stringer is stretched most is limited to be less than twice the length thereof in the tape longitudinal direction at a coupling head in the fastener element row.

Consequently, in the slide fastener of JP-A-63-294804, no pulling phenomenon or feeling of disharmony is generated when the slide fastener is attached to clothes having stretching property because the slide fastener attaching portion is stretched corresponding to the stretching/contraction of the clothes. This enables to improve feeling of wearing the clothes and to obtain excellent appearance. In addition, the element attaching portion of the fastener tape is provided with stretching property, and a maximum stretching amount of the fastener element row is limited as described above. As a result, occurrence of breaking of chain in the slide fastener due to loss of engagement of the fastener elements can be prevented for certain even if the element attaching portion is stretched.

In recent years, in a variety of clothes such as sporting clothes, the ones having a higher function have been demanded and developed to cope with an application and purpose. Currently, clothes having high stretching property whose fabric stretching property is further intensified have been marketed and spread.

On the other hand, the slide fastener disclosed in JP-A-63-294804 needs to be applied with a load of 4 kg in the longitudinal direction of the fastener tape to stretch the element attaching portion by 10% or more in the tape longitudinal direction. Assume that the slide fastener mentioned in JP-A-63-294804 whose element attaching portion has such a degree of stretching is used in highly stretchable clothes whose stretching property is intensified highly. If a load of less than 4 kg (for example, a load of about 1 kg) is applied, the highly stretchable clothes is stretched easily corresponding to its motion, but the slide fastener mentioned in JP-A-63-294804 does not have so sufficient stretching property allowing itself to follow up the motion of the highly stretchable clothes. For this reason, there are such faults that a pulling phenomenon occurs in the attaching portion of the slide fastener or feeling of remarkable disharmony is generated when wearing or on the appearance, and these problem need to be solved.

SUMMARY OF THE INVENTION

The present invention has been achieved in view of the above-described conventional problems, and an object of the invention is to provide a fastener stringer for a slide fastener which, when it is used in fabric whose stretching property is intensified largely, can follow up its stretching/contracting action smoothly by improving the stretching property of an element attaching portion, and even if the element attaching portion is stretched, can prevent the breaking of chain from occurring in fastener element rows kept in engagement, and further a slide fastener including the fastener stringer.

To achieve the above-described object, according to an aspect of the present invention, there is provided a fastener stringer for a slide fastener including: a fastener tape composed of a weaving structure having a tape main portion and an element attaching portion; a continuous fastener element row sewed to the element attaching portion of the fastener tape with a sewing thread which is a non-elastic yarn; and an elastic core thread inserted through an interior of the fastener element row, an elastic yarn and a non-elastic yarn being woven into the tape main portion and the element attaching portion as warp yarns while a non-elastic yarn is woven as a weft yarn, wherein the elastic yarn and the non-elastic yarn as the warp yarns are woven so that a weaving ratio of the elastic yarn to the non-elastic yarn in the element attaching portion is larger than that of the elastic yarn to the non-elastic yarn in the tape main portion.

In the slide fastener having a separable bottom end stop according to the present invention, the element attaching portion and the core thread have a degree of stretching which allows themselves to be stretched by 10% or more when a load of 1 kg is applied in a longitudinal direction. In addition, the amount of stretching in the longitudinal direction of the element attaching portion, the fastener element row and the core thread is limited by the sewing thread so that a pitch between adjacent elements of the fastener element row when the fastener stringer is stretched most is less than twice the length thereof in the tape longitudinal direction at a coupling head in the fastener element row.

According to the present invention, preferably, the elastic yarn is constituted by winding a polyester filament yarn around a polyurethane elastic yarn. Further, it is preferable that the core thread is constituted by twisting a plurality of the elastic yarns together. Moreover, it is preferable that the elastic yarn is woven regularly at predetermined intervals in the tape main portion.

According to another aspect of the present invention, there is provided a slide fastener including the fastener stringer having the above-described configuration.

In the fastener stringer for a slide fastener of the invention, the elastic yarn and non-elastic yarn which serve as the warp yarns in the tape main portion and the element attaching portion of the fastener tape are woven such that the weaving ratio of the elastic yarn to the non-elastic yarn in the element attaching portion is larger than that of the elastic yarn to the non-elastic yarn in the tape main portion.

For example, in the conventional slide fastener disclosed in JP-A-63-294804, as described above, the elastic yarn and the non-elastic yarn are used together as the warp yarn in the tape main portion and the element attaching portion of the fastener tape, and the elastic yarns are woven regularly at predetermined intervals in the weaving structure constituted of the non-elastic yarns in the tape main portion and the element attaching portion. For this reason, the weaving ratio of the elastic yarn to the non-elastic yarn in the element attaching portion is adjusted to be equal to that of the elastic yarn to the non-elastic yarn in the tape main portion.

In the element attaching portion of the fastener tape, the fastener element row in which the core thread is inserted is sewed with a sewing thread which is a non-elastic yarn, and the core thread itself is constituted by covering the elastic yarn with a covering layer composed of the non-elastic yarn. Thus, in JP-A-63-294804, even if the elastic yarn is woven into the element attaching portion, the stretching property of the element attaching portion is hampered by the non-elastic yarn woven in the element attaching portion, the non-elastic sewing thread with which the fastener element row is sewed, and the core thread covered with the non-elastic yarn. As a consequence, when the slide fastener is sewed to the highly stretchable fabric, the degree of stretching of the element attaching portion is insufficient.

To the contrary, the fastener stringer of the invention changes an arrangement of the elastic yarn and non-elastic yarn woven as the warp yarns of the fastener tape between the element attaching portion and the tape main portion. This increases the weaving ratio of the elastic yarn in the element attaching portion as compared to the weaving ratio of the elastic yarn in the tape main portion, thereby improving the stretching property of the element attaching portion largely. Consequently, the fastener stringer of the invention reduces influences by sewing the fastener element row to the element attaching portion with the sewing thread upon the stretching property relatively so as to secure a sufficient stretching property in the element attaching portion.

Particularly, the fastener stringer of the invention is formed such that the element attaching portion has the degree of stretching which allows itself to be stretched by 10% or more when a load of 1 kg is applied in the tape longitudinal direction by increasing the weaving ratio of the elastic yarn in the element attaching portion. Further, it is also formed such that the core thread has the degree of stretching which allows itself to be stretched by 10% or more when a load of 1 kg is applied in the longitudinal direction thereof. Therefore, the fastener stringer of the invention can stretch the element attaching portion with less load as compared to the slide fastener of JP-A-63-294804 and the degree of stretching (stretching property) of the element attaching portion is excellent. For this reason, when the fastener stringer of the invention is sewed to fabric having high stretching property, the fastener tape can be stretched or contracted easily following up an stretching/contracting action of the fabric smoothly, thereby causing no pulling phenomenon or feeling of disharmony and providing excellent feeling upon wearing the clothes and excellent appearance.

Further, an amount of stretching in the longitudinal direction of the element attaching portion, the fastener element row and the core thread in the fastener stringer of the invention is limited by the non-elastic sewing thread which sews the fastener element row and the core thread to the element attaching portion. Specifically, the amount of stretching is limited such that a pitch between adjacent elements of the fastener element row when the fastener stringer is stretched most is less than twice the length thereof in the tape longitudinal direction at the coupling head of the fastener element row. Consequently, the fastener stringer of the invention can prevent the breaking of chain due to loss of engagement of the fastener elements even if the element attaching portion is stretched with right and left fastener element rows in engagement with each other.

Because the elastic yarn is constituted by winding a polyester filament yarn around polyurethane elastic yarn in the present invention, the degree of stretching of the elastic yarn can be adjusted by 120% to 160% by changing the amount of winding of the polyester filament yarn. Such elastic yarn is woven into the element attaching portion at a larger weaving ratio than the tape main portion, which makes it possible to easily apply to the element attaching portion the degree of stretching which allows stretching by 10% or more when a load of 1 kg is applied.

Further, because the core thread is constituted by twisting a plurality of elastic yarns together, the core thread can be also easily applied with the degree of stretching by 10% or more when a load of 1 kg is applied as described.

According to the present invention, the stretching property in the tape longitudinal direction can be provided equally in a tape width direction to the tape main portion because the elastic yarn is woven regularly at predetermined intervals into the tape main portion. Consequently, the fastener stringer can be sewed to a highly stretchable fabric more stably, thereby further improving feeling upon wearing the clothes and appearance.

Further, in the slide fastener of the invention including the fastener stringer configured as described above, the stretching property of the element attaching portion of the fastener tape is remarkably improved. Thus, even if the slide fastener of the invention is sewed to a fabric having a high stretching property, it can follow up the stretching/contracting action smoothly. Additionally, in the slide fastener of the invention, the amount of stretching in the longitudinal direction of the element attaching portion, the fastener element row and the core thread is limited as described above. With this configuration, it is possible to prevent the breaking of chain due to loss of engagement between right and left fastener element rows in engagement even when the element attaching portion is stretched corresponding to the stretching/contracting action of the highly stretchable fabric.

DESCRIPTION OF THE PREFERRED EMBODIMENTS

Hereinafter, embodiments of the present invention will be described in detail with reference to accompanying drawings. In the meantime, the present invention is not restricted to respective embodiments described below but may be modified in various ways as long as substantially the same configuration as the present invention is possessed and the same operation and effect are exerted. For example, although a fastener stringer in which coil-like fastener element rows are attached by sewing to an element attaching portion of a fastener tape is described in the following embodiments, the present invention is not restricted to this example but for example, the fastener stringer may be formed by sewing zigzag-like fastener element rows instead of the coil-like fastener element rows.

Figure 1:
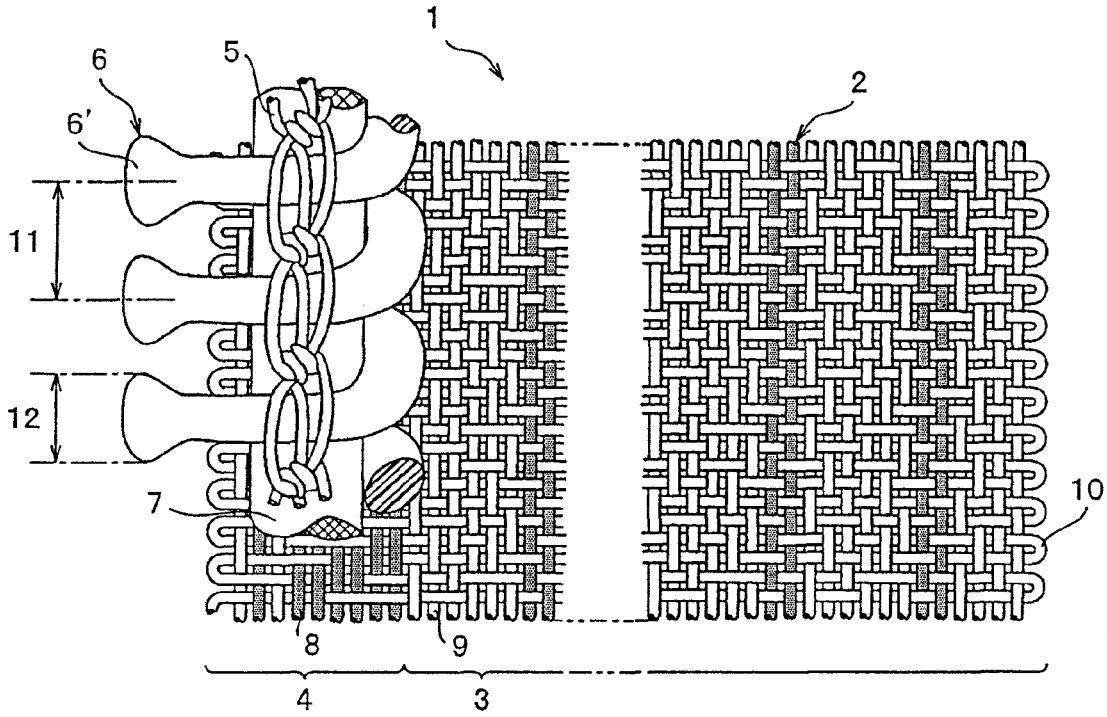
FIG. 1 is a structure diagram schematically showing a weaving structure of a fastener stringer of the invention.
Figure 2:
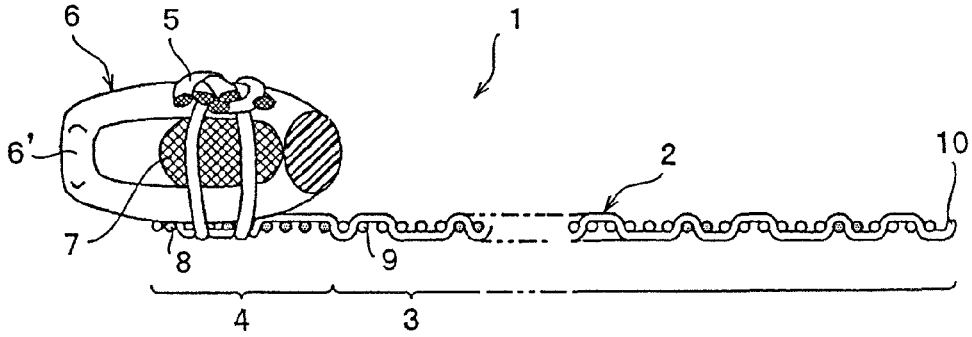
FIG. 2 is a cross-sectional view schematically showing a section of the slide fastener.

FIG. 1 is a structure diagram schematically showing a weaving structure of a fastener stringer according to this embodiment. FIG. 2 is a cross-sectional view schematically showing a cross-section of the fastener stringer.

As shown in FIGS. 1 and 2, the fastener stringer 1 of this embodiment includes a fastener tape 2 having a tape main portion 3 and an element attaching portion 4, a coil-like fastener element row 6 sewed to the element attaching portion 4 with a sewing thread 5, and a core thread 7 which is inserted through an interior of the fastener element row 6 and sewed together with the fastener element row 6 with the sewing thread 5. In the meantime, the element attaching portion used herein refers to an area containing at least a portion overlapping the core thread of the fastener tape (a tape portion which the core thread overlaps) in the tape width direction, particularly, a tape portion which overlaps the fastener element row (a tape portion which the fastener element row overlaps).

The fastener tape 2 is woven using a narrow fabric loom which completes a single weft beating-up by reciprocating a weft yarn within an identical opening of a warp yarn with a carrier and the element attaching portion 4 is formed along one side edge of the tape main portion 3. An elastic yarn 8 and a non-elastic yarn 9 are woven into the tape main portion 3 and the element attaching portion 4 of the fastener tape 2 as the warp yarns while a non-elastic yarn 10 is woven as the weft yarn, so that the weaving structure shown in FIG. 1 is formed.

In this embodiment, Spandex covered yarn which is constituted by winding a polyester filament yarn around a polyurethane elastic yarn is used as the elastic yarn 8 for use as the warp yarn, and polyester processed yarn is used as the non-elastic yarns 9, 10 for use as the warp yarn and weft yarn.

In the present invention, materials of the elastic yarn and non-elastic yarn are not restricted to any particular one. For example, the elastic yarn may be selected appropriately from a rubber thread composed of elastomer and a covered yarn obtained by covering the rubber thread by winding a spun yarn or filament around it. As the non-elastic yarn for use as the warp yarn or weft yarn, conventionally ordinarily used one may be employed such as a spun yarn, mono-filament, or multi-filament. Although a size of the elastic yarn and non-elastic yarn is not restricted to any particular one, it is preferable to use, for example, an elastic yarn and non-elastic yarn which can apply a preferred strength to the fastener tape 2 and have a size allowing a sewing needle to pass through when the fastener element row 6 is sewed to the element attaching portion 4.

As the warp yarn in the tape main portion 3, two elastic yarns 8 are arranged in line every time when six non-elastic yarns 9 are disposed, and at the same time, the elastic yarns 8 are woven in regularly at specified intervals so that the ratio of the quantity of the non-elastic yarns 9 is larger than the elastic yarns 8. By weaving in the plural non-elastic yarns 9 in parallel arranged in this way and the plural elastic yarns 8 in parallel arranged in a quantity smaller than that of the plural non-elastic yarns 9 regularly, stretching property in a tape longitudinal direction can be provided equally in a tape width direction to the tape main portion 3.

The element attaching portion 4 of the fastener tape 2 is woven using seven elastic yarns 8 and two non-elastic yarns 9, and a non-elastic yarn 9 is used as a warp yarn disposed on a side edge on a side of a coupling head 6'. Then, the non-elastic yarn 9 and elastic yarn 8 are arranged alternately at least once or preferably twice repeatedly, and the elastic yarns 8 are arranged continuously up to a side edge on an opposite side to the element attaching portion 4, so as to construct the element attaching portion 4 so that the ratio of the quantity of the non-elastic yarns 9 is smaller than the elastic yarns 8. More specifically, in the fastener tape 2 of this embodiment, the weaving ratio of the elastic yarn 8 to the non-elastic yarn 9 in the element attaching portion 4 is adjusted to be larger than the weaving ratio of the elastic yarn 8 to the non-elastic yarn 9 in the tape main portion 3 by changing a quantity and arrangement of the elastic yarns 8 and non-elastic yarns 9 to be woven as the warp yarns between the tape main portion 3 and the element attaching portion 4. In the present invention, it is preferable that the non-elastic yarn 9 is used as the warp yarn disposed on both side edges of the fastener tape 2. Consequently, a configuration of the fastener tape 2 is stabilized, so that a fastener tape having an excellent appearance can be produced.

The elastic yarn 8 and non-elastic yarn 9 are woven into the element attaching portion 4 as the warp yarns at this time as described above, so that the element attaching portion 4 is provided with a degree of stretching allowing itself to be stretched by 10% or more when a load of 1 kg is applied in the tape longitudinal direction. In this embodiment, the two non-elastic yarns 9 are woven into the element attaching portion 4 near a tape side edge. In the present invention, however, an arrangement position of the elastic yarn 8 and non-elastic yarn 9 in the element attaching portion 4 is not restricted to any particular one but may be changed appropriately as required.

The core thread 7 is inserted through the interior of the fastener element row 6 and sewed to the element attaching portion 4 with the sewing thread 5 such that the coupling head 6' of the coil-like fastener element row is projected from the tape side edge of the fastener tape 2. This fastener element row 6 is produced by winding synthetic fiber mono-filament such as polyamide or polyester into a coil-like shape, and the core thread 7 is inserted through the interior of the fastener element row 6, so as to stabilize mounting of the fastener element row 6 onto the element attaching portion 4 and further stabilize a coupling operation of the fastener element row 6. As the sewing thread 5 for use in sewing the fastener element row 6, a non-elastic twisted yarn constituted by twisting polyester mono-filament is used.

The core thread 7 is formed as a twisted yarn obtained by twisting nine Spandex covered yarns together, the Spandex covered yarn being constituted by winding a polyester filament yarn around a polyurethane elastic yarn and provided with the degree of stretching allowing itself to be stretched by 10% or more when a load of 1 kg is applied in the longitudinal direction.

In the fastener stringer 1 of this embodiment, a pitch 11 between adjacent elements in the fastener element row 6 when the stretching amount in the longitudinal direction of the element attaching portion 4, the fastener element row 6 and the core thread 7 reaches the maximum is limited to less than twice a length 12 in the tape longitudinal direction of the coupling head 6' in the fastener element row 6 by the sewing thread 5. The pitch 11 refers to an interval in the tape longitudinal direction between center lines of the adjacent coupling heads 6' in the fastener element row 6 as shown in FIG. 1.

A method of restricting the stretching amount in the longitudinal direction by the sewing thread 5 will be described.

For example, when manufacturing the fastener stringer 1 of this embodiment, a predetermined tension is applied to the warp yarn constituting the fastener tape 2 in order to weave the fastener tape 2. Further, in the fastener tape 2 to be woven, a weaving ratio of the elastic yarn 8 in the element attaching portion 4 is set larger than that of the elastic yarn 8 in the tape main portion 3. Consequently, an extremely curved so-called bias that an element attaching portion side is concave while a tape side edge portion on the other side is convex is generated in the woven fastener tape 2.

Thus, when the fastener element row 6 is sewed to the fastener tape 2 in which such a bias is generated, first, the fastener tape is held in a linear configuration by applying a tension of a predetermined magnitude in the tape longitudinal direction to the fastener tape 2. Next, with a tension of the predetermined magnitude applied to the fastener element row 6 through which the core thread 7 is inserted, the fastener element row 6 is placed on the element attaching portion 4 of the fastener tape 2 held in the linear configuration. Thereafter, the fastener element row 6 is sewed to the element attaching portion 4 by driving a sewing needle through the core thread 7 and the element attaching portion 4.

When the tension applied to the fastener tape 2, the core thread 7 and the fastener element row 6 is released after the fastener element row 6 is sewed so that tension applied on an entire fastener tape 2 is released. At this time, the element attaching portion 4, the core thread 7 and the fastener element row 6 are contracted more than the tape main portion 3 due to application of elastic forces of the elastic yarn 8 and the core thread 7. A size (length) of the contraction at this time is secured as a stretching amount in the tape longitudinal direction. In the meantime, because the element attaching portion 4, the core thread 7 and the fastener element row 6 have a larger percentage of contraction than the tape main portion 3, the fastener element row 6 can follow up the contraction action smoothly. When the element attaching portion 4 and the core thread 7 are contracted, the sewing thread 5 as a non-elastic yarn absorbs the contraction due to intermittent formation of a loop as shown in FIG. 1.

By sewing the fastener element row 6 in this way, the fastener stringer 1 is blocked by the sewing thread 5 from being stretched longer than the length thereof when the fastener element row 6 is sewed. A magnitude of tension applied to the fastener tape 2, the core thread 7 and the fastener element row 6 is adjusted when sewing the fastener element row 6 considering an amount of contraction of the element attaching portion 4, the core thread 7 and the fastener element row 6 which are contracted after the fastener element row 6 is sewed. Consequently, the stretching amount in the longitudinal direction of the element attaching portion 4, the fastener element row 6 and the core thread 7 can be limited to a predetermined magnitude securely.

In the fastener stringer 1 of this embodiment, the core thread 7 and the fastener element row 6 are sewed to the fastener tape 2 containing such a bias with tension applied, the bias being generated because the fastener tape 2 is woven with the weaving ratio of the elastic yarn 8 in the element attaching portion 4 set larger than that of the tape main portion 3. With this configuration, the element attaching portion 4 and the core thread 7 can be provided with an excellent degree of stretching, and further, the stretching amount of the element attaching portion 4, the core thread 7 and the fastener element row 6 can be limited to a specified range. Accordingly, the fastener stringer 1 of this embodiment can prevent the breaking of chain from being caused by loss of engagement of fastener elements even when the element attaching portion 4 is stretched with the right and left fastener element rows 6 engaging each other.

Figure 3:
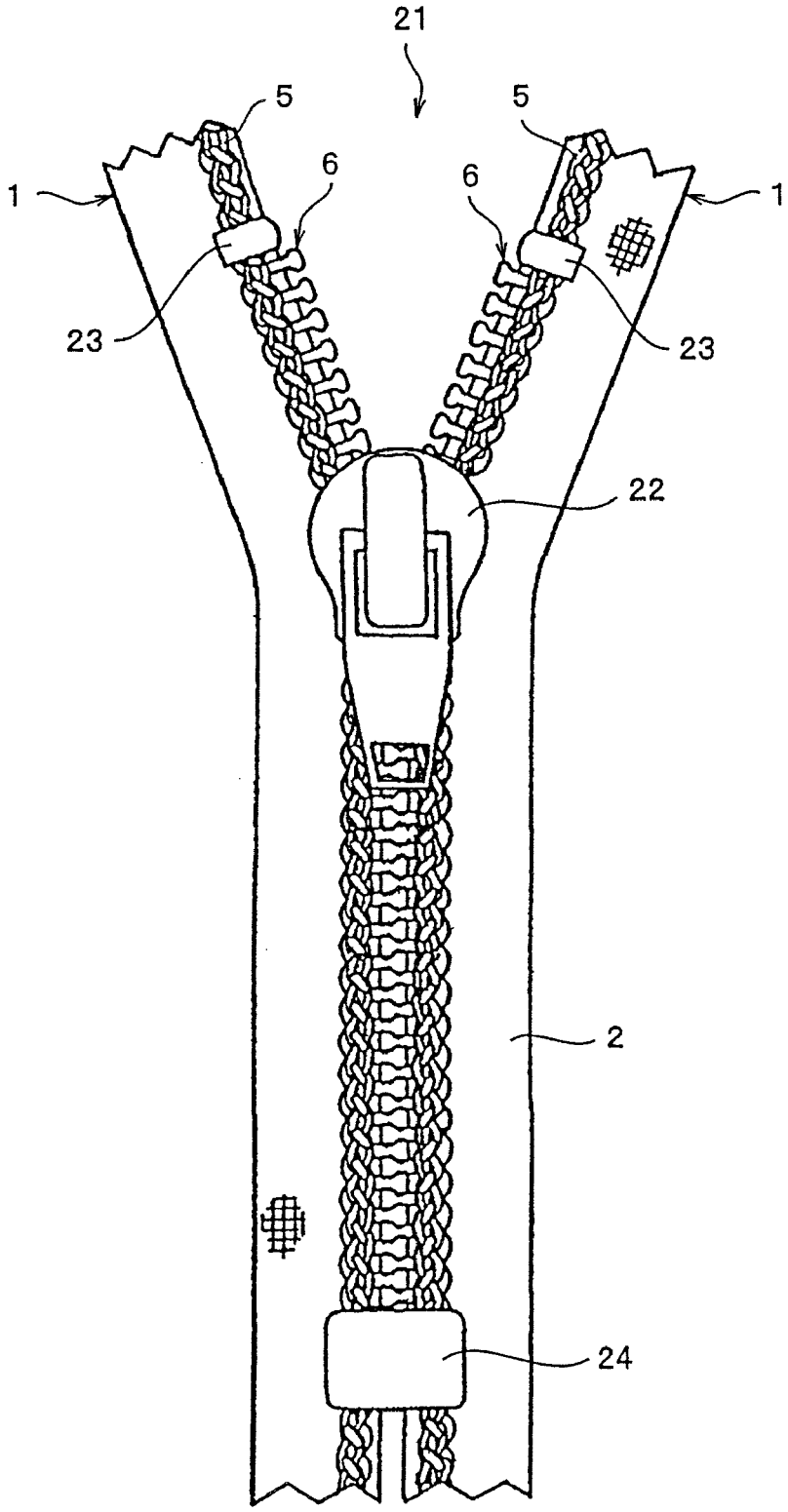
FIG. 3 is a front view schematically showing a slide fastener of the present invention.

Next, a slide fastener formed using the fastener stringer 1 of this embodiment will be described. FIG. 3 is a front view schematically showing the slide fastener of this embodiment.

In a slide fastener 21 shown in FIG. 3, a slider 22 having a pull tag is inserted through the fastener element rows 6 sewed to the fastener stringer 1. A top end stop 23 as a stop end is attached to a top end portion of the fastener element row 6, while a bottom end stop 24 which couples both bottom end portions such that they cannot be separated is attached to a bottom end portion of the fastener element row 6. The slider 22 is disposed so as to be slidable between the top end stop 23 and the bottom end stop 24. In the meantime, it is permissible to configure the slide fastener by providing with a separable bottom end stop which is constituted of a separable pin, a box pin and a box to enable the bottom end portion to be separated instead of the aforementioned bottom end stop 24.

In the slide fastener 21 of this embodiment, the degree of stretching in the element attaching portion 4 and the core thread 7 of the fastener tape 2 is improved largely, so that the element attaching portion 4 and the fastener element row 6 can be stretched with a smaller load than the conventional slide fastener. For this reason, even if the tape main portion 3 of the fastener tape 2 is sewed to a fabric having a high stretching property, it can follow up the stretching/contracting action of the fabric smoothly to enable the fastener tape 2 to be stretched/contracted easily. Consequently, excellent feeling when a user wears the clothes and excellent appearance can be secured without causing the conventional fault such as a pulling phenomenon and feeling of disharmony by using the above-mentioned slide fastener 21 in highly stretchable clothes.

Moreover, in the slide fastener 21 of this embodiment, the stretching amount in the tape longitudinal direction of the element attaching portion 4, the fastener element row 6 and the core thread 7 is limited within a predetermined range by the sewing thread 5 as described above. Therefore, even if the element attaching portion is stretched corresponding to the stretching/contracting action of the highly stretchable clothes, the pitch 11 between the adjacent elements in the fastener element row 6 is never increased twice or more the length 12 in the tape longitudinal direction at the coupling head 6' in the fastener element row 6. Accordingly, the breaking of chain in the slide fastener 21 can be prevented securely.

What is claimed is:

1. A fastener stringer for a slide fastener, comprising:

a fastener tape composed of a weaving structure having a tape main portion and an element attaching portion;

a continuous fastener element row sewed to the element attaching portion of the fastener tape with a sewing thread which is a non-elastic yarn; and an elastic core thread inserted through an interior of the fastener element row, an elastic yarn and a non-elastic yarn being woven into the tape main portion and the element attaching portion as warp yarns and a non-elastic yarn being woven as a weft yarn, wherein the elastic yarn and the non-elastic yarn as the warp yarns are woven so that a weaving ratio of the elastic yarn to the non-elastic yarn in the element attaching portion is larger than a weaving ratio of the elastic yarn to the non-elastic yarn in the tape main portion, thereby the element attaching portion having a degree of stretching by 10% or more when a load of 1 kg is applied in a longitudinal direction of the element attaching portion.

2. The fastener stringer according to claim 1, wherein an amount of stretching in the longitudinal direction of the element attaching portion, the fastener element row and the core thread is limited by the sewing thread so that a pitch between adjacent elements of the fastener element row when the fastener stringer is stretched most is less than twice a length of a coupling head in the fastener element row in a tape longitudinal direction at the coupling head in the fastener element row.

3. The fastener stringer according to claim 1 or 2, wherein the elastic yarn is constituted by winding a polyester filament yarn around a polyurethane elastic yarn.

4. The fastener stringer according to any one of claims 1 and 2, wherein the core thread is constituted by twisting a plurality of the elastic yarns together.

5. The fastener stringer according to any one of claims 1 and 2, wherein the elastic yarn is woven regularly at predetermined intervals in the tape main portion.

6. A slide fastener including the fastener stringer according to any one of claims 1 and 2.

7. The slide faster according to claim 1, wherein the at least one or more non-elastic yarns are formed on a side edge of the coupling head side of the fastener element row in the element attaching portion.

8. The slide fastener according to claim 1, wherein the fastener tape main portion comprises of more than one elastic yarn and non-elastic yarn interlaces with each other at a predetermined number.

* * * * *